US005335830A

United States Patent [19]

Cater

[11] Patent Number: 5,335,830

[45] Date of Patent: * Aug. 9, 1994

[54] PUMP DISPENSER FOR LOTIONS AND/OR LARGE DOSES OF PRODUCT

[75] Inventor: Miro S. Cater, Newtown, Conn.

[73] Assignee: Bespak Plc, Norfolk, England

[ * ] Notice: The portion of the term of this patent subsequent to Feb. 8, 2011 has been disclaimed.

[21] Appl. No.: 9,964

[22] Filed: Jan. 27, 1993

Related U.S. Application Data

[63] Continuation-in-part of Ser. No. 964,385, Oct. 21, 1992.

[51] Int. Cl.[5] ..... B05B 11/00

[52] U.S. Cl. ..... 222/153; 222/321

[58] Field of Search ..... 222/153, 321, 383, 384, 222/385, 402.11, 380

[56] References Cited

U.S. PATENT DOCUMENTS

| | | | |
|---|---|---|---|
| 3,502,035 | 3/1970 | Fedit et al. | 222/321 X |
| 4,183,449 | 1/1980 | Blake | 222/321 |
| 4,340,158 | 7/1982 | Ford et al. | 222/384 X |
| 4,369,899 | 1/1983 | Magers et al. | 222/153 |
| 4,371,097 | 2/1983 | O'Neill | 222/383 X |
| 4,991,746 | 2/1991 | Schultz | 222/384 X |
| 5,096,094 | 3/1992 | Guilbert | 222/384 X |

*Primary Examiner*—Kevin P. Shaver

[57] ABSTRACT

Upper and lower hollow cylinders communicate with each other. The diameter of the upper cylinder is larger than that of the lower cylinder. The lower cylinder has an opening through which fluid to be dispensed can be introduced. A piston has an upper vertical hollow cylindrical section open at opposite ends with a first extension in peripheral sealing engagement with the inner surface of the upper cylinder and a lower extension in peripheral sealing engagement with the inner surface of the lower cylinder. An aperture is located in the second extension between its ends. A vertical stem is slidable within and extends through the upper section of the piston. The stem has an enlargement spaced below its upper end. A vertical discharge conduit is coaxial with the piston and stem. An actuator is disposed above the upper cylinder, being secured to the upper end of the stem and having a horizontal discharge channel which communicates with the discharge conduit. The actuator slidably receives the upper end of the upper section of the piston in a region defining a gap. The stem is biased by a spring to close the discharge conduit and to position the enlargement above the aperture when the dispenser is in rest position. The spring is disposed outside the cylinders to exert an upwardly directed biasing force against the actuator and against the upper end of the stem. The piston and actuator can be interconnected in such manner that the dispenser can be placed in locked down position without actuation. This interconnection can be used regardless of the placement of the spring outside or inside the cylinders.

15 Claims, 7 Drawing Sheets

PUMP DISPENSER FOR LOTIONS AND/OR LARGE DOSES OF PRODUCT

CROSS REFERENCE TO COPENDING APPLICATION

The present application is a continuation-in-part of copending application entitled PUMP DISPENSER WITH COMBINED INLET AND OUTLET PORTS, filed Oct. 21, 1992, Ser. No. 07/964385 Appropriate portions of the disclosure in the copending application are incorporated by reference into the present application.

BACKGROUND OF THE INVENTION

Pump dispensers are manually operated devices typically disposed on the top of a container of fluid for dispensing the fluid in a desired form from a dispenser nozzle. Dispensers of this type employ a cylindrical body structure, at least one piston and separate inlet and outlet ports individually controlled by separate means for opening and closing them. However, pump dispensers are utilized for dispensing lotions, which can be thick, highly viscous fluids, and or for dispensing large dosages of product, typically about one cubic centimeter of product per stroke, have certain unique requirements. Known dispensers of this type have a relatively large number of components. In order to avoid accidental actuation during shipment, such dispensers are shipped in a down locked sealed position. This arrangement requires actuation and discharge each time before the dispenser is locked in sealed position.

The present invention is directed toward a new and improved pump dispenser for lotions and/or large dosages of product wherein the number of components is reduced and wherein actuation and discharge will not take place during locking operations.

SUMMARY OF THE INVENTION

Accordingly, it is an object of the present invention to provide a new and improved pump dispenser for lotions and/or large dosages of product which is characterized by a structure using fewer components.

Another object is to provide a new and improved pump dispenser of the character indicated wherein all metal parts can be positioned out of contact with the fluid, thus permitting dispensing of fluids which are subject to undesired chemical reactions when in contact with metal.

Yet another object is to provide a new and improved pump dispenser which can be locked and sealed in the down position in such manner that actuation and discharge will not take place during locking operations.

These and other objects and advantages of the invention will either be explained or will become apparent hereinafter.

In accordance with the principles of the invention, the new type of pump dispenser employs a body consisting of upper and lower hollow cylinders which communicate with each other. The diameter of the upper cylinder is larger than that of the lower cylinder. These cylinders define an outer boundary of a pump chamber. The lower cylinder has an opening through which fluid to be dispensed can be introduced.

A piston is slidable in said body and defines an inner boundary of the pump chamber. The piston has an upper vertical hollow cylindrical section open at opposite ends with a first extension in peripheral sealing engagement with the inner surface of the upper cylinder and a lower and smaller extension in peripheral sealing engagement with the inner surface of the lower cylinder. The second extension has upper and lower ends, the lower end being open. An aperture is located in the second extension between its ends.

A vertical stem is slidable within and extends through the upper section of the piston. The stem has an enlargement spaced below its upper end.

First means forms a vertical discharge conduit coaxial with the piston and stem.

An actuator is disposed above the body. The actuator is secured to the upper end of the stem and has a horizontal discharge channel which communicates with the discharge conduit. The actuator slidably receives the upper end of the upper section of the piston in a region defining a gap.

Second means when the dispenser is in rest position biases the stem to close the discharge conduit and to position the enlargement above the aperture. This second means in accordance with this invention is disposed outside the body to exert an upwardly directed biasing force against the actuator and hence against the upper end of the stem. When the second means is so disposed, all metal parts can be positioned outside of the body and out of contact with any fluid, thus permitting dispensing of fluids which are subject to undesired chemical reactions when in contact with metal.

In the structure defined above, third means common to the piston and actuator can be provided for interconnecting the piston and actuator in such a manner that the dispenser can be placed in locked down position without actuation. This third means can be used not only when the second means is disposed outside of the body but also as disclosed in the aforementioned application of which this application is a continuation-in-part, when the second means is disposed within the body and exerts an upward biasing force against the head of the stem.

When the dispenser is in rest position, the enlargement is disposed above the aperture and engages the piston to close the discharge conduit. Once the dispenser has been primed and the upper cylinder filled with fluid, the actuator can be depressed to initiate a discharge. The stem initially moves downward relative to the piston and the enlargement opens the discharge conduit and moves below the aperture. Once the stem has moved downward sufficiently, the gap in the region of the actuator receiving the upper end of the piston is closed and the piston and stem move downwardly together to force the fluid in the upper cylinder through the aperture and the discharge conduit for discharge through the actuator.

After discharge is completed, the stem initially moves upwardly relative to the piston to open the gap and close the discharge conduit. The aperture remains open. Suction draws the fluid upward through the lower cylinder into the upper cylinder, with the piston and stem moving upwardly together until the actuation cycle is completed and the dispenser is returned to rest position.

DETAILED DESCRIPTION OF PREFERRED EMBODIMENTS

Figure 1:
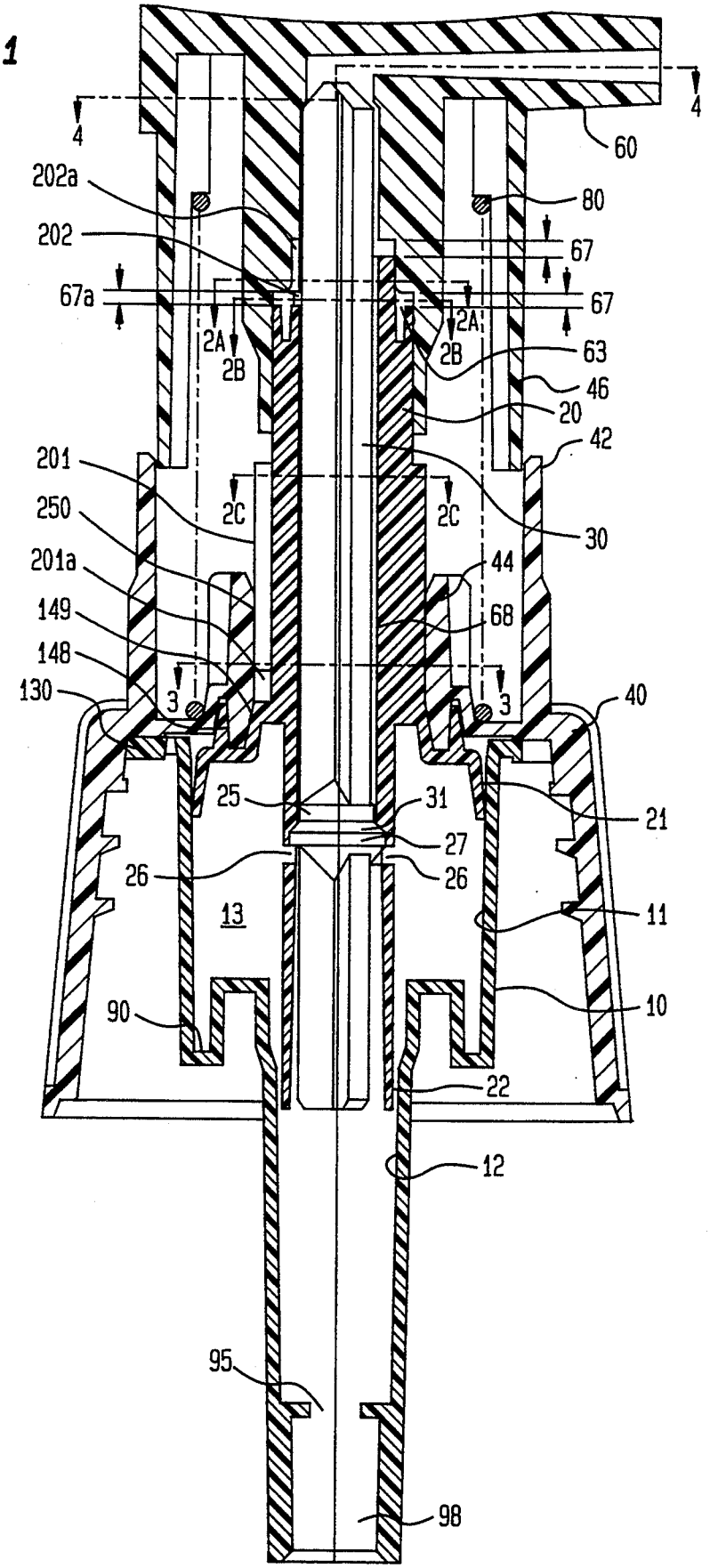
FIG. 1 is a vertical cross sectional view of a preferred embodiment utilizing a biasing means disposed outside of the body and incorporating the locking mechanism.
Figure 2A:
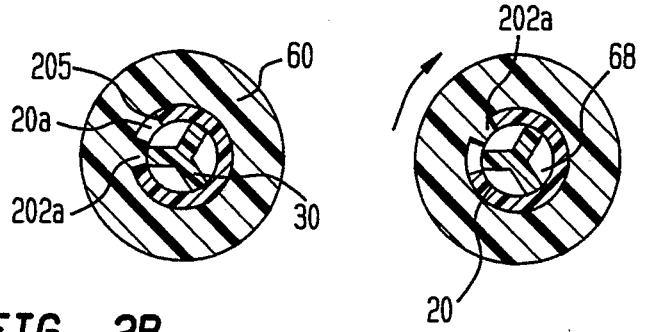
FIGS. 2a–2c are views through line A—A in FIG. 1 showing the embodiment in unlocked and locked positions and also in transit between positions.
Figure 2B:
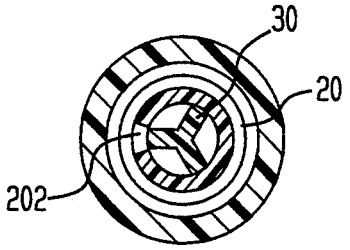
Figure 2C:
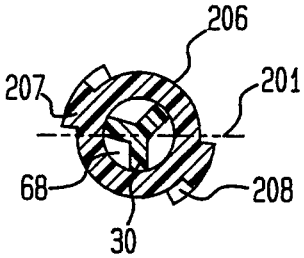
Figure 3:
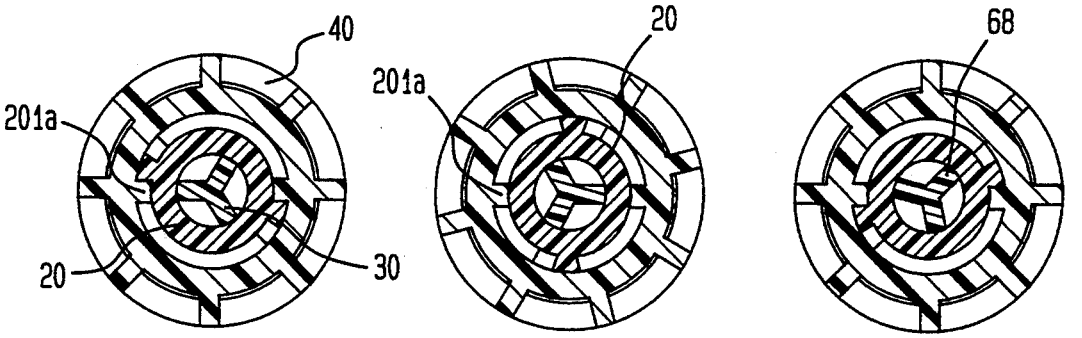
FIGS. 3 is a view through line B—B in FIG. 1 showing the embodiment in unlocked and locked positions and also in transit between positions.
Figure 4:
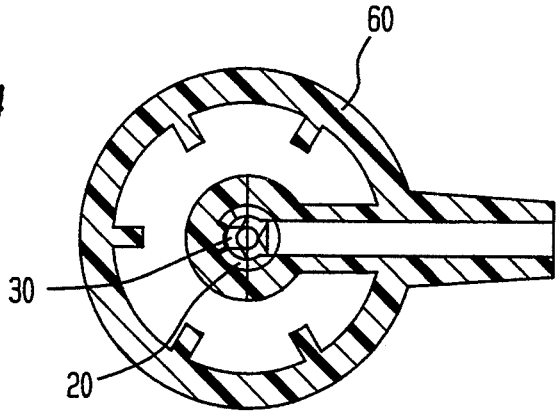
FIG. 4 is a view through line C—C in FIG. 1.
Figure 5:
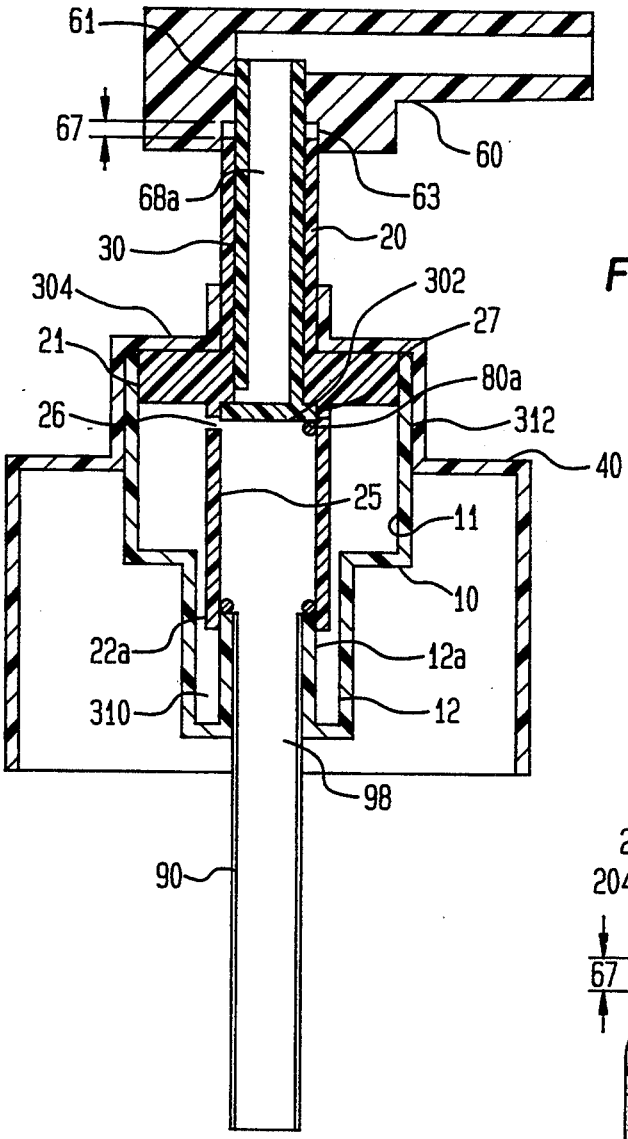
FIG. 5 is a cross sectional view of an other preferred embodiment using a biasing means disposed within the body.
Figure 9:
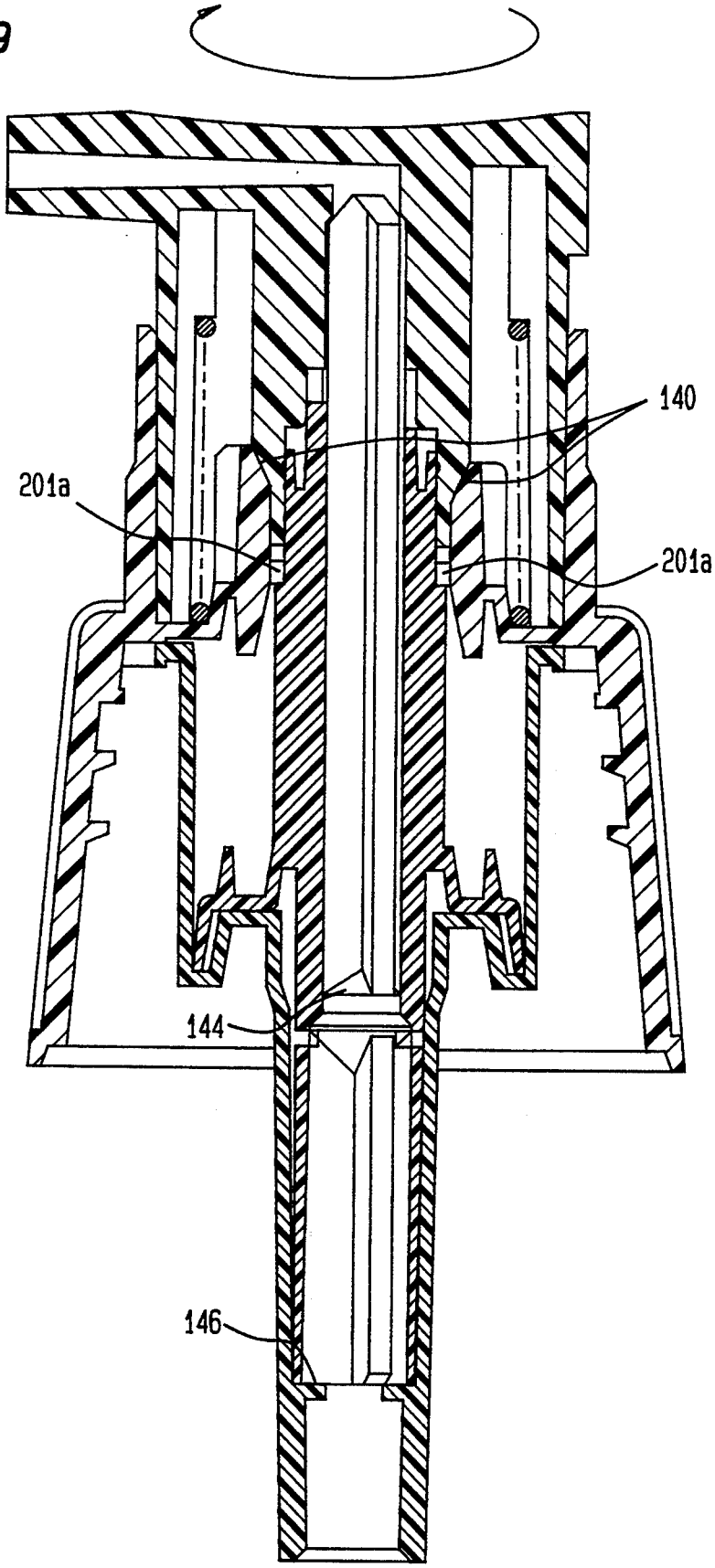
FIG. 9 is a view of the embodiment of FIG. 1 in locked position.
Figure 10:
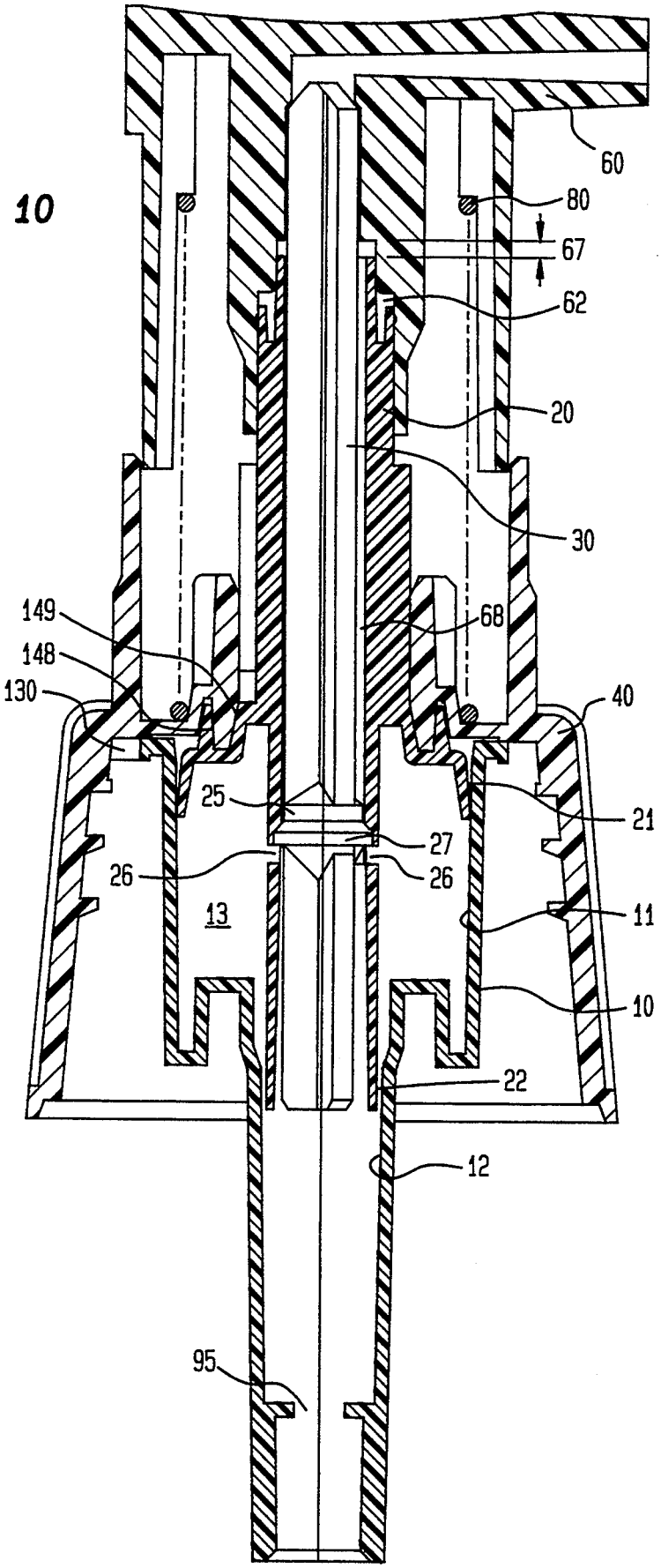
FIG. 10 is a cross sectional view of a modified form of the embodiment of FIG. 1 which lacks the locking and unlocking mechanism of FIG. 1.

FIG. 1 with the accompanying cross sections shown in FIGS. 2–4 and 6–9 illustrates an embodiment which uses a biasing means disposed outside of the body and incorporates the locking mechanism explained in general terms above. FIG. 10 illustrates a modification of the embodiment of FIG. 1 wherein the locking mechanism has been eliminated. FIG. 5 shows an embodiment similar to that of FIGS. 1–9 which uses a biasing means disposed within the body and incorporates the same locking mechanism.

Referring first to FIGS. 1–4, and 6–10, the dispenser utilizes a hollow upper cylinder 11 having a first diameter and an integral hollow lower cylinder 12 having a second and smaller diameter.

A piston has a vertical hollow upper section 20, a first extension 21 having a large sealing periphery which is in continuous sealing engagement with the inner surface of cylinder 11 and a second smaller extension 22. The inner surface of the lower end of section 20 has the shape of an inwardly extending contoured recess shown at 25. Extension 22 takes the shape of a vertical hollow cylinder having an open upper and lower ends, the upper end being integral with the lower end of section 20. The lower end of extension 22 has a sealing periphery which is in continuous sealing engagement with the inner surface of cylinder 12. Extension 22 has two openings 26 which are horizontally aligned and are equidistantly spaced and define an aperture.

A stem 30 is slidably disposed within the piston, being spaced inwardly from section 20. The stem in horizontal cross section consists of three equidistantly spaced legs defining three discharge passages 96 therebetween. An enlargement in the form of a shoulder 31 interconnects the upper and lower portions. Shoulder 31 can engage the recess 25 to form a seal therewith. Shoulder 31 has a vertical outer surface 27 which has a sealing periphery always in continuous sealing engagement with the inner surface of extension 22.

An annular region 90 is formed between the upper end of the lower cylinder and the lower end of the upper cylinder. Region 90 can be used as a lower stop for the movement of the extension 21. The lower end of cylinder 12 can have an inlet opening 98 through which a dip tube [not shown] can extend.

An actuator 60 is rigidly secured to the top end of the stem as shown at 61. A passage 62 is formed between an upper portion of the stem and the actuator to form a discharge region connected to discharge path 96. Passage 62 is connected to discharge nozzle 70. A gap 67 is formed between the upper end of region 30 of the piston and a recess 63 in the actuator. The upper end seals against the recess 63 and remains in sliding peripheral engagement therewith.

The upper end of cylinder 11 is mounted in a collar 40 which has an upwardly extending concentric inner and outer hollow cylindrical portions 44 and 42. Both portions 44 and 42 are open at their tops. Portion 44 is open at bottom. The upper section 20 of the piston is in sliding engagement with the portion 44. Actuator 60 has a lower cylindrical hollow section 46 open at its lower end which can slide into portion 42 when the actuator is depressed.

A spring or other biasing means 80 disposed outside the body bears at its lower end against the collar and bears at its upper end against the inner surface of section 46, thus applying an upwardly exerted biasing force against the actuator and the stem which is secured to the actuator. Thus the spring, which is the only metal component used in the dispenser is disposed out of contact with the fluid in the dispenser, with the resultant advantages previously explained.

Figure 7:
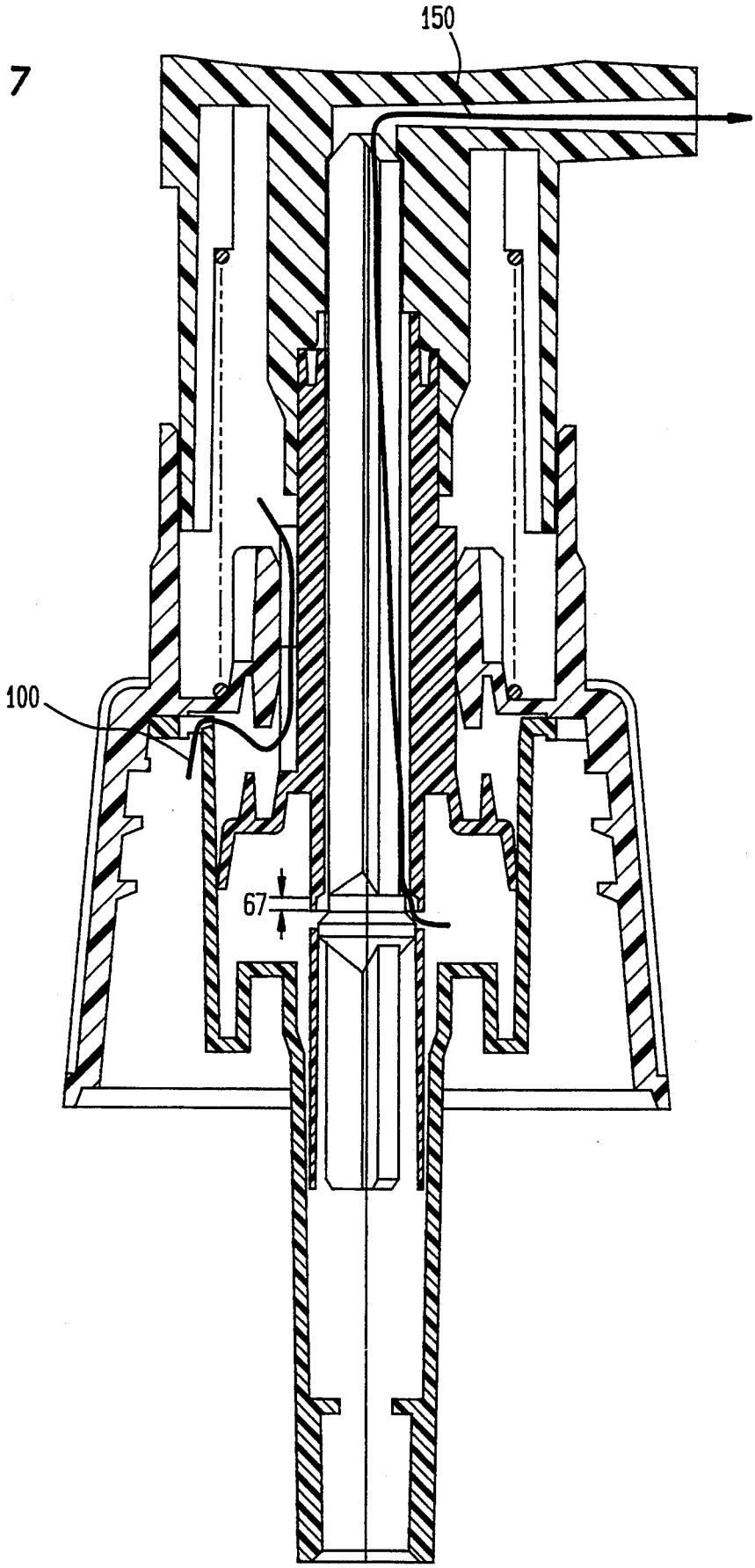
FIG. 7 is a view of the embodiment of FIG. 1 shown in active stroke and illustrating the discharge path.
Figure 8:
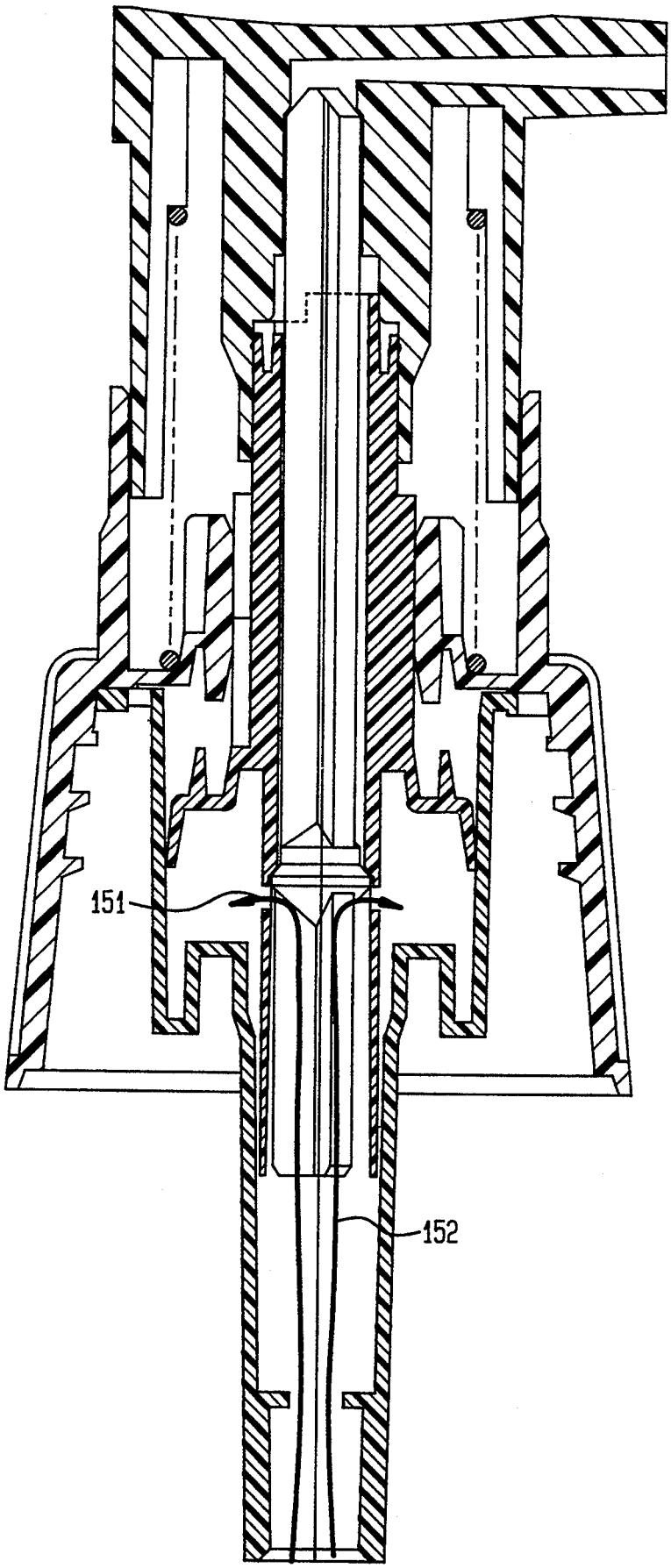
FIG. 8 is a view of the embodiment of FIG. 1 showing the refill path in the return stroke and the path which empties the contents of the pump chamber into the container during the lock-down stroke.

The lower open end of portion 44 terminates in opposite conical surfaces 148 and 149 which seal against the piston in fully raised position as shown in FIG. 1. The upper end of portion 44 has a conical surface 140 which seals against the actuator in fully lowered position as shown in FIG. 9. In between fully raised and fully lowered positions, air is vented via path 100 as shown in FIG. 7.

In the rest position, shoulder 31 engages surface 25 and closes the discharge path. In this position, the shoulder is disposed at least partially above the aperture.

When downward pressure is applied to the actuator, the actuator and stem travel downwards against the force of the spring while the frictional forces between the cylinders and the extensions maintain the piston motionless. The depth of the gap 67 decreases progressively. The sealing surfaces 25 and 31 begin to separate as the stem moves downwardly relative to the piston while the shoulder moves into alignment with the aperture and closes it. As the actuation continues, the gap is reduced to zero, the piston is forced downward by the actuator, the discharge path is opened, and the shoulder moves below the aperture and opens it. The fluid is forced out of the upper cylinder as the fluid volume is reduced because of the downward movement of the piston and is further forced through the aperture, the discharge path and the discharge region for discharge through the nozzle.

Once the downward pressure is removed from the actuator, the spring forces the stem and actuator upwards. The frictional forces between the extensions and the cylinders maintain the piston initially motionless until the shoulder engages surface 25 and closes the discharge path. The piston and stem move upwards, producing a suction which draws the fluid upward in the lower cylinder, through the aperture and into the upper cylinder. This process continues until the piston and stem are returned to the rest position and the shoulder is then returned to its rest position.

The structure of FIG. 5 is shown in simplified form, since it functions in essentially the same manner as the embodiment of FIG. 1 except that the simplified structure incorporates a spring or other biasing means disposed within the fluid path with the disadvantages previously described. The structure of FIG. 5, absent the locking means described in detail below, is shown in more detail in the aforementioned copending application of which the present application is a continuation-in-part.

Referring now to FIG. 5, the dispenser utilizes a hollow upper cylinder 11 having a first diameter and an integral hollow lower cylinder 12 having a second and smaller diameter.

A piston has a vertical hollow upper section 20, a first extension 21 having a large sealing periphery which is in continuous sealing engagement with the inner surface of cylinder 11 and a second smaller extension 22A. The lower end of section 20 has an opening 25. Extension 22A takes the shape of a vertical hollow cylinder having an open upper and lower ends, the upper end being integral with the lower end of section 20. Extension 22 has one or more openings 26 which are horizontally aligned and are spaced equidistantly and define an aperture. The lower end of extension 22 has a sealing periphery which is in continuous sealing engagement with the inner surface of cylinder 12A.

A hollow stem 30 is slidably disposed within section 20 of the piston. The stem is open at its upper end and has an enlargement in the form of disc 302 at its lower end. The stem has an opening 304 disposed therein adjacent but above the disc 302. The hollow interior of the stem defines a vertical discharge path 68A for the fluid as will be explained below. Disc 302 can engage the opening 25 to close it. Disc 302 has a vertical outer surface 27 forming a sealing periphery always in continuous sealing engagement with the inner surface of extension 22.

The lower end of cylinder 12 can have an inlet opening 98 through which a dip tube 90 can extend. This opening can define the bottom open end of a vertical hollow cylinder 12A extending upwardly and concentrically within cylinder 12. The separation between cylinder 12 and cylinder 12A defines an annular region 310. The lower end of extension 22 can be lowered into region 310 while remaining in continuous sealing engagement with the inner surface of cylinder 12A.

An actuator 60 is rigidly secured to the top end of the stem as shown at 61. A passage 68A is connected to discharge path 96. Passage 62 is connected to discharge opening. A gap 67 is formed between the upper end of section 20 of the piston and a recess 63 in the actuator. The upper end seals against the recess 63 and remains in sliding peripheral engagement therewith.

The upper end of cylinder 11 is mounted in a collar 40 which has an upwardly extending hollow cylindrical region 312. The upper section 20 of the piston is in sliding engagement with the region 312.

A spring or other biasing means 80A disposed inside the body bears at its lower end against the upper end of cylinder 12A and bears at its upper end against the disc 302, thus applying an upwardly exerted biasing force against the stem.

In the rest position, disc 302 closes opening 25 and closes the discharge path. In this position, the disc is disposed above the aperture and blocks access of fluid to opening 304.

When downward pressure is applied to the actuator, the actuator and stem travel downwards against the force of the spring while the frictional forces between the cylinders and the extensions maintain the piston motionless. The depth of the gap 67 decreases progressively. Disc 302 begins to separate from opening 25 as the stem moves downwardly relative to the piston while the shoulder moves into alignment with the aperture and closes it. As the actuation continues, the gap 67 is reduced to zero, the piston is forced downward by the actuator, the discharge path is opened, and the disc moves below the aperture and opens it. The fluid is forced out of the upper cylinder as the fluid volume is reduced because of the downward movement of the piston and is further forced through the aperture, opening 304, the discharge path 68A and the discharge region for discharge through the nozzle.

Once the downward pressure is removed from the actuator, the spring forces the stem and actuator upwards. The frictional forces between the extensions and the cylinders maintain the piston initially motionless until the disc engages opening 25 and closes the discharge path. The piston and stem move upwards, producing a suction which draws the fluid upward in the lower cylinder, through the aperture and into the upper cylinder. This process continues until the piston and stem are returned to the rest position and the shoulder is then returned to its rest position.

The embodiments of FIG. 1 and FIG. 5 utilize the same third means common to the piston and actuator for interconnecting the piston and actuator in such manner that the dispenser can be placed in locked down position without actuation.

As has been explained above, some relative vertical motion between the actuator and the piston takes place in order to initiate the discharge of fluid. If this relative motion does not take place, there can be no discharge. The third means selectively inhibits this relative motion, thus preventing actuation.

Figure 6:
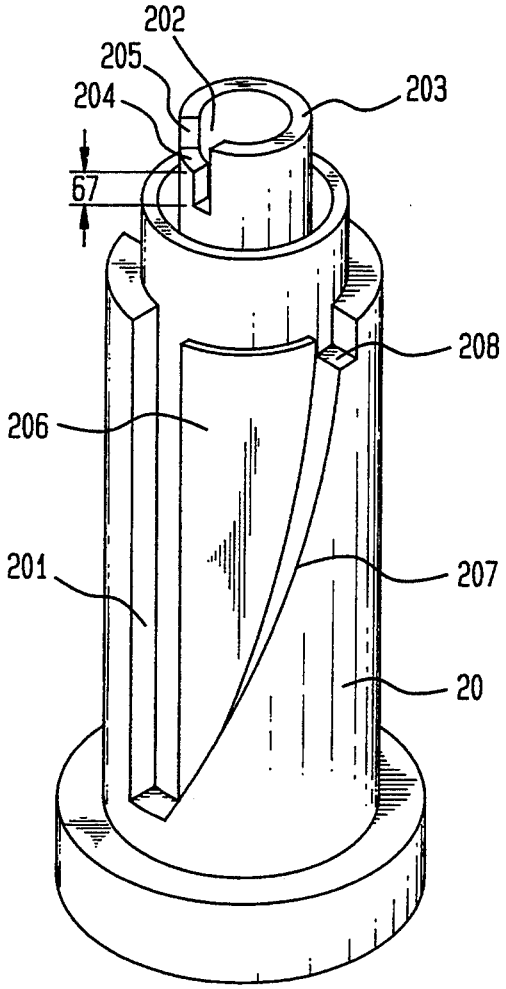
FIG. 6 is an enlarged detail perspective view of the top portion of the piston of FIG. 1.

The description that follows refers to FIG. 6.

Piston 20 has two identical equidistantly spaced axial slots 201 whose length is equal to the stroke of the pump. Each of these slots 201 engages a corresponding one of mating teeth 201A disposed in the center of opening 250. During normal actuation, the piston remains oriented with the collar 40 as the teeth ride within the slots.

The top surface 203 of the piston incorporates a key slot 202 which is normally aligned with tooth 202A of the actuator 60. A gap 67 is formed between the surface 203 and the bottom of the cavity 63 in the actuator. An equivalent gap 67A is formed between the bottom of the key slot 202 and the top of the tooth 202A. The bottom of the key slot 202 is spaced below the top surface by twice the length of the gap 67.

During normal actuation of the dispenser both gaps 67 and 67A are reduced to zero in the manner previously described.

However, half way down the length of key slot 202, a secondary horizontal step 204 extends from one vertical wall of the key slot half way to the other vertical wall. The actuator can be rotated about a vertical axis to align the tooth 202A with the step 204 whereby the actuator and piston are so aligned that the gap 67A cannot be reduced. Consequently, during a downstroke with the actuator and piston aligned in this fashion, the discharge path remains closed while the fluid inlet path remains open. The contents of the fluid in cylinder 11 are displaced downwardly back into the container.

In order to lock the dispenser in the fully actuated locked position, the actuator must be rotated clockwise while pushing it down.

When the actuator is rotated clockwise, tooth 202A is first positioned above the step 204. This action maintains the discharge path closed during further actuation. Continued rotation causes tooth 202A to engage a vertical wall 205 of the slot 204 and caused the piston to rotate. Teeth 201A are disengaged from the axial slots 201 and move upward along corresponding ones of helical surfaces 207. When the dispenser is fully actuated, teeth 201A engage corresponding upper slots 208. Vertical outwardly extending ridges 206 are disposed between slots 201 and 208 to retain the teeth 201A in slots 208. The dispenser is then locked in down position.

In order to unlock the dispenser, the actuator is rotated counterclockwise, causing tooth 202A to engage the opposite wall of key slot 202. Further rotation causes the teeth 201A to become disengaged from slots 208 and engage the helical surfaces 207. The spring bias forces the piston upward and the teeth 201A move downward along the helical surfaces and become reengaged with the axial slots 201. This completes the upstroke and returns the actuator and piston to rest position. During the upstroke, the cylinder 11 is refilled with fluid.

While the dispensers disclosed herein have been described with particular reference to the drawings, the protection solicited is to be limited only by the terms of the claims which follow.

What is claimed is:

1. A pump dispenser comprising:

a body consisting of upper and lower hollow cylinders of dissimilar diameters which communicate with each other, the diameter of the upper cylinder being larger than the diameter of the lower cylinder, said cylinders defining an outer boundary of a pump chamber;

a piston defining the inner boundary of the pump chamber, the piston having an upper vertical hollow section open at both ends with a first extension in peripheral sealing engagement with the inner surface of the upper cylinder and a lower and smaller second extension in peripheral sealing engagement with the inner surface of the lower cylinder, the second extension having upper and lower ends, the lower end being open, the second extension having an aperture therein located between its ends;

a vertical stem slidable within the upper section of the piston;

first means forming a vertical discharge conduit coaxial with the piston and stem;

an actuator disposed above the body, the actuator being secured to the upper end of the stem and coupled to the upper end of the piston;

second means biasing the stem into position to close the discharge conduit and open the aperture when the dispenser is in rest position;

third means for locking the actuator in a down position;

fourth means for closing a passage between the upper end of the piston and the actuator; and said third and fourth means being manually operable and having a first position at which the actuator is locked in a down position and the passage is closed and a second position at which the actuator is not locked and the passage is open for normal operation of the dispenser.

2. The dispenser of claim 1 wherein the fourth means is placed in the first position by rotating the actuator in one direction with respect to the body and is placed in the second position by rotating the actuator in the opposite direction.

3. The dispenser of claim 2 wherein the second means is disposed within the body and engages the lower end of the stem.

4. The dispenser of claim 2 wherein the second means is disposed outside of the body and bears against the actuator.

5. The dispenser of claim 4 wherein the upper end of the upper cylinder engages a collar disposed beneath the actuator and the biasing means is disposed between the collar and the actuator.

6. The dispenser of claim 5 wherein the third and fourth means when in the first position prevents any relative vertical motion from taking place between the actuator and piston at the beginning of a downstroke and when in the second position permits said motion to take place and initiate a fluid discharge.

7. The dispenser of claim 6 wherein the piston has two identical equidistantly spaced slots whose length is equal to the stroke of the piston.

8. The dispenser of claim 7 wherein said fourth means comprises a vertical key slot is disposed in the piston and extends downwardly from the top surface thereof.

9. The dispenser of claim 8 wherein the key slot has oppositely disposed vertical walls and is provided half way down the length thereof with a secondary horizontal step.

10. The dispenser of claim 9 wherein the secondary step extends from one vertical wall half way to the other vertical wall.

11. The dispenser of claim 10 wherein the fourth means further comprises a tooth in the actuator which is aligned with the key slot when the actuator is in said second position to initiate a fluid discharge and which is spaced from the key slot and engages the step when the actuator is in the said first position.

12. A pump dispenser comprising:

a body consisting of upper and lower hollow cylinders of dissimilar diameters which communicate with each other, the diameter of the upper cylinder being larger than the diameter of the lower cylinder, said cylinders defining an outer boundary of a pump chamber;

a piston defining an inner boundary of the pump chamber, the piston having an upper vertical hollow section open at both ends with a first extension in peripheral sealing engagement with the inner surface of the upper cylinder and a lower and smaller second extension in peripheral sealing engagement with the inner surface of the lower cylinder, the second extension having upper and lower ends, the lower end being open, the second extension having an aperture therein located between its ends;

a vertical stem slidable within the upper section of the piston and having an enlarged head at its lower end;

first means forming a vertical discharge conduit coaxial with the piston and stem;

an actuator disposed above the body, the actuator being secured to the upper end of the stem and coupled to the upper end of the piston; and second means disposed outside of the body and bearing against the actuator to bias the stem into position to close the discharge conduit and open the aperture when the dispenser is in rest position.

13. The dispenser of claim 12 wherein the piston is vertically slidable within the pump chamber with the first extension being slidably confined to the upper cylinder and the second extension being slidably movable in both cylinders while remaining in sealing engagement with the lower cylinder.

14. The dispenser of claim 13 wherein the dispenser is in rest position, the head is disposed above the aperture and closes the port.

15. The dispenser of claim 14 wherein during an downstroke, the port is opened and the head is disposed below the aperture and wherein during an upstroke, the port is closed and the head is disposed above the aperture.

* * * * *